US005797315A

United States Patent [19]

Norris

[11] Patent Number: 5,797,315

[45] Date of Patent: Aug. 25, 1998

[54] MARKING PUNCH GUIDE DEVICE

[76] Inventor: Keith E. Norris, 305 Biddle St., Greenville, Tenn. 37745

[21] Appl. No.: 882,278

[22] Filed: Jun. 25, 1997

[51] Int. Cl.[6] ..... B31F 1/07

[52] U.S. Cl. ..... 101/28; 101/29

[58] Field of Search ..... 101/368, 398, 101/18, 28, 29; 400/128

[56] References Cited

U.S. PATENT DOCUMENTS

| | | | |
|---|---|---|---|
| 3,201,967 | 8/1965 | Balamuth | 72/359 |
| 4,422,783 | 12/1983 | Houk | 400/128 |
| 4,437,400 | 3/1984 | Ellis | 101/18 |
| 4,764,987 | 8/1988 | Drei | 2/243 |
| 5,368,400 | 11/1994 | Cyphert et al. | 400/124.01 |

*Primary Examiner*—Edgar S. Burr
*Assistant Examiner*—Dave A. Ghatt

[57] ABSTRACT

Disclosed is a guide device for one or more character punches wherein one or more punch guide blocks are slidably mounted on a rod mounted on a base, wherein each block has a surface which slidably contacts the base and each has a punch guide slot or aperture, and wherein a series of position or ruler markings are provided on a portion of the base, and a cooperating alignment edge is provided on each block or on each punch mounted therethrough and lies contiguous the series of ruler markings, whereby each block can be precisely positioned on the base with respectively to any particular one of the markings.

8 Claims, 1 Drawing Sheet

MARKING PUNCH GUIDE DEVICE

BACKGROUND OF THE INVENTION

1. Field

This invention concerns a device for imprinting numbers, letters or other characters into hard surfaces wherein the imprinting requires the use of a punch operation, wherein a variety of characters is required, and wherein proper placement of the device on the workpiece is often difficult.

2. Prior Art

Heretofore various mechanisms and apparatus' have been proposed for making the character imprinting operation easier, such mechanisms being shown, for example, in U.S. Pat. Nos. 4,422,783 and 4,899,652, the disclosures of which are hereby incorporated herein by reference. These prior devices have their own specialized functions and are of complex specialized construction, and do not have the versatility and ease of use, especially accuracy of use which applicant requires.

A principal object therefore, of the present invention is to greatly enhance the versatility and accuracy of marking punch holders or guide devices and to do so in an economical and structurally simple manner.

SUMMARY OF THE INVENTION

The above and other objects hereinafter appearing have been attained in accordance with the present invention thru the discovery of structure for a holder or guide for one or more character punches wherein one or more punch guide blocks are slidably mounted on a rod and each has a surface which slidably contacts the holder base and each has a punch guide slot or aperture, and wherein a series of position or ruler markings are provided on a portion of the holder base, and a cooperating alignment edge is provided on each block or on each punch mounted therethrough and lies contiguous the series of ruler markings, whereby each block can be precisely positioned on the holder with respect to any particular one of the markings.

BRIEF DESCRIPTION OF THE DRAWINGS

The invention will be understood further from the following drawings of preferred embodiments and the description thereof, wherein.

DETAILED DESCRIPTION OF THE DRAWINGS

Figure 1:
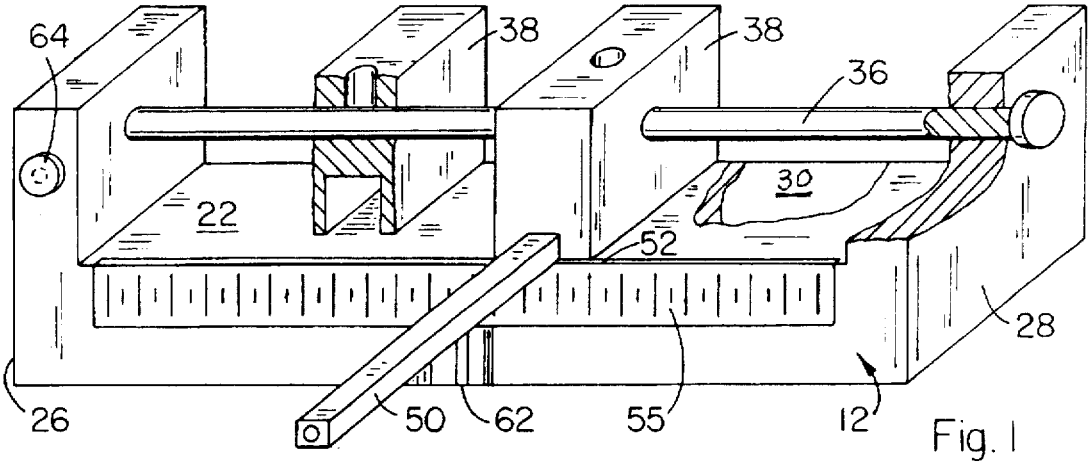
FIG. 1 is a frontal perspective view of the present holder.

With reference to the drawings, the present punch guide device 10 comprises an elongated base means 12 of non-magnetic material, e.g., aluminum, and having opposite ends 14, 16, front side 18 and rear side 20 and a substantially flat first slide surface 22 lying in a first plane 24 and positioned intermediate a pair of support members 26, 28 positioned at the opposite ends of the base means and extending generally normally and outwardly from said slide surface 22. A workpiece 29 contact surface 30 is provided on rear side 20 of the base means and lies generally in a second plane 32 which is oriented substantially perpendicular to said first plane 24. Permanent magnet means 34 are mounted into contact surface 30 and their outer surfaces lies substantially in second plane 32. Straight rod means 36 is removably mounted on and extends between the support members above first slide surface 22 and parallel thereto.

Figure 4:
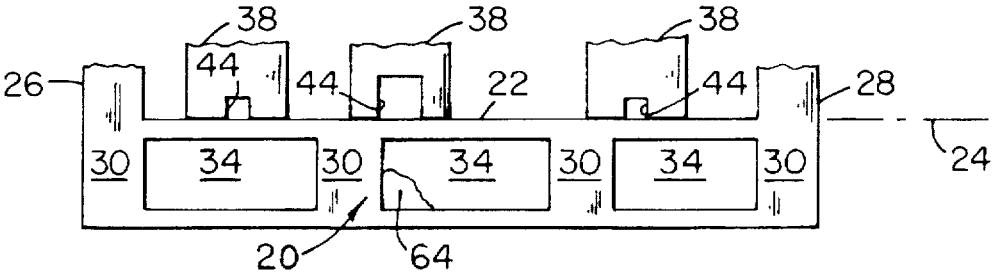
FIG. 4 is an elevational view of the rear of attachment side of present holder showing multiple guide blocks for various size markings punches and a preferred dimension and placement of the magnets.

At least one guide block means 38 having a longitudinal axis 42 is provided having a bearing aperture 40 therethrough in which the rod means is slidably mounted on said axis 42, the block means having a flat second slide surface 43, which surface 43 also lies in first plane 24, the block means being slidable along its longitudinal axis 42 on the rod means and on the first slide surface to any selected position intermediate the support members. A punch guide slot 44 is formed into the second slide surface 43 along a lateral or punch axis 48 and opening directly onto the first slide surface, said slot being adapted to slidably receive an elongated character punch 50. It is noted that when multiple block means 38 as shown in FIGS. 1 and 4 are provided, the punch guide slots 44 can be differently dimensioned to accommodate larger or smaller constructed character punches.

At least one of said block means or punch has at least one alignment edge such as 52, the punch having at least one elongated flat surface 54 adapted to lie directly against the first slide surface. Ruler means 55 mounted on front side 18 adjacent front edge 56 of the first slide surface 22 and extends substantially the length of the first slide surface whereby any particular measurement indicia 58 of ruler means 55 is adapted to lie immediately adjacent at least one alignment edge 52 of the punch or block means when the block means and punch are moved on the rod to a preselected position on the first slide surface.

In one preferred embodiment, the ruler means comprises a machinist steel ruler which insets precisely into recess 60 in the front side of the holder and is held therein by the force of magnets 34. A cut-out 62 such as the concave recess shown in the front side allows the operator to easily pick the ruler out of its recess 60 and replace it by another so that, e.g., either standard or metric scales may be used.

The magnets 34 may be of any permanent type and are preferably secured by adhesive, e.g., epoxy to the rear side 20 in recesses 64 as to lie substantially flush with side 20 such that they cannot be easily knocked off of the base.

Figure 2:
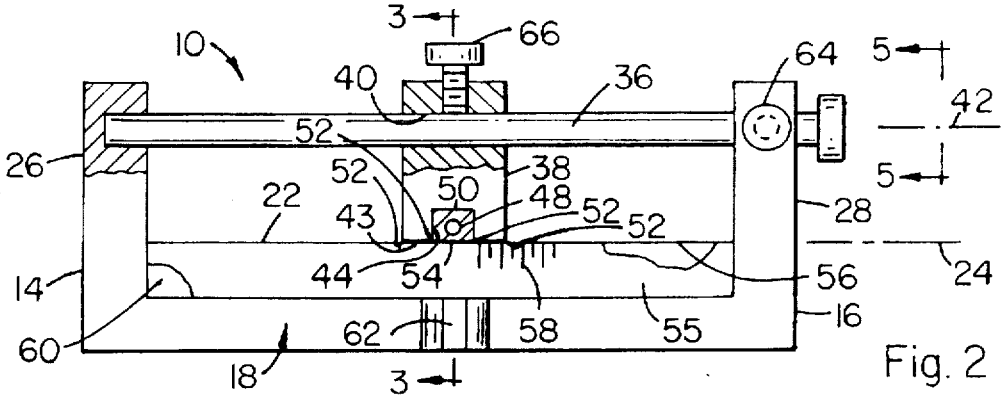
FIG. 2 is a front side elevational view of the holder of FIG. 1 with portions broken away for clarity, and showing only a segment of the ruler markings.
Figure 3:
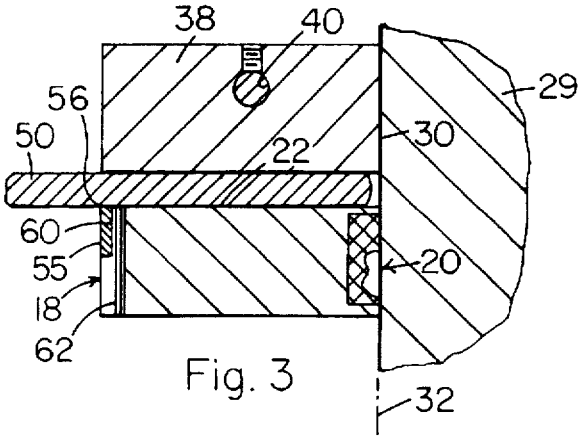
FIG. 3 is a cross-sectional view taken along line 3—3 of FIG. 2 in the direction of the arrows.
Figure 5:
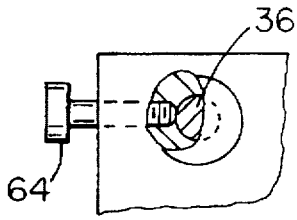
FIG. 5 is a partial end view taken in the direction of arrow 5 in FIG. 2.

The rod 36 is preferably constructed to be easily removable such that the number and punch slot size of blocks 38 can be quickly changed. A structure such as shown in FIG. 2 is preferred and utilizes a thumb screw 64 threaded into support member 28 to block the rod in place after it has been positioned as shown. A thumbscrew 66 is preferred to lock each block 38 in place on the rod after the block has been precisely positioned thereon with respect tot he selected ruler markings.

The invention has been described in detail with particular reference to preferred embodiments thereof, but it will be understood that variations and modifications will be effected with the spirit and scope of the invention.

I claim:

1. A guide device for one or more character punches wherein said device comprises a base means, rod means mounted on said base means, one or more punch guide block means slidably mounted on said rod means, wherein each said block means has a surface which slidably contacts said base means, each said block means having a punch guide slot formed into said surface for slidably mounting a character punch, a series of ruler markings provided on a portion of said base means, alignment edge means provided on each said block means or on each punch mounted therethrough, said edge means lying contiguous the series of said ruler markings whereby each block means and any punch mounted in its guide slot can be precisely positioned on the device with respect to any selected one of said markings by sliding of said block means along said rod means and said base means, and wherein permanent magnet means is provided on said base means for removably securing said device to a workpiece.

2. The device of claim 1 wherein cooperating first lock means is provided on each said block means and said rod means for maintaining a precise position of said block means with respect to said markings during the character punching operation.

3. The device of claim 2 wherein said rod means is removable from said base means whereby one or more of said block means can be removed from said rod means or placed thereon, and wherein cooperating second lock means is provided on said rod means and said base means for maintaining a fixed position of said rod means on said base means.

4. The device of claim 1 wherein multiple block means are provided each having a differently dimensioned punch guide slot.

5. The device of claim 1 wherein each said guide slot means is formed along an axis, and wherein said permanent magnet means is positioned on said base means in a plane which is oriented perpendicularly to said axis.

6. A punch guide device comprising an elongated base means of non-magnetic material and having opposite ends, a front side and a rear side and a substantially flat first slide surface lying in a first plane, a pair of support members positioned at said opposite ends of said base means and extending generally normally and outwardly from said slide surface, said slide surface lying intermediate said support members, a workpiece contact surface on said rear side of said base means and lying generally in a second plane which is oriented substantially perpendicular to said first plane, permanent magnet means mounted thru said contact surface and lying substantially in said second plane, straight rod means removably mounted on and extending between said support members above said first slide surface and parallel thereto, at least one guide block means having a longitudinal axis and also having a bearing aperture therethrough along said axis and slidably receiving said rod means, said block means having a flat second slide surface lying also in said first plane, said block means being slidable along its longitudinal axis on said rod means and on said first slide surface to selected positions intermediate and support members, a punch guide slot formed into said second slide surface of said block means along a lateral punch axis and opening directly onto said first slide surface, said slot being adapted to slidably receive an elongated character punch, said punch having at least one elongated flat surface adapted to lie against said first slide surface, an alignment edge on at least one of the structures selected from the group consisting of said block means adjacent said second slide surface thereof or said punch adjacent said flat surface thereof, and ruler means mounted on said front side of said base means adjacent a front edge of said first slide surface and extending substantially the length of said first slide surface whereby any particular measurement indicia of said ruler means is adapted to lie immediately adjacent at least one of said alignment edges of said punch or block means when said block means is moved on said rod to a preselected position on said first slide surface.

7. The device of claim 6 wherein said base means is aluminum, and said ruler means comprises a machinist steel ruler which insets precisely into a recess in said front side of said base means and is held therein by the force of said magnet means.

8. The device of claim 7 wherein concave recess means is provided in said front side of said base means and partially underlies said ruler means to allow the operator to easily pick said ruler means off of said base means and be replaced by a differently scaled ruler.

* * * * *